United States Patent [19]

Gleim

[11] 4,306,960

[45] Dec. 22, 1981

[54] COAL LIQUEFACTION AND OIL UPGRADING PROCESS TO OBTAIN MAXIMUM YIELD OF DISTILLATE

[75] Inventor: William K. T. Gleim, Seattle, Wash.

[73] Assignee: Energy Modification Inc.

[21] Appl. No.: 134,768

[22] Filed: Mar. 28, 1980

[51] Int. Cl.[3] ..... C10G 1/00; C10J 3/68

[52] U.S. Cl. ..... 208/8 LE; 48/201

[58] Field of Search ..... 48/201; 208/8 LE

[56] References Cited

U.S. PATENT DOCUMENTS

| | | | |
|---|---|---|---|
| 1,436,289 | 11/1922 | Plauson | 208/8 LE |
| 3,642,608 | 2/1972 | Roach et al. | 208/8 |
| 3,929,193 | 12/1975 | Duke | 208/8 LE X |
| 3,980,451 | 9/1976 | McMahon | 48/201 X |
| 4,111,786 | 9/1978 | Sugimura et al. | 208/8 LE |
| 4,120,664 | 10/1978 | Gleim | 208/8 LE X |

FOREIGN PATENT DOCUMENTS 362424 11/1931 United Kingdom .

*Primary Examiner*—Delbert E. Gantz
*Assistant Examiner*—William G. Wright
*Attorney, Agent, or Firm*—Peter J. Georges

[57] ABSTRACT

A portion of higher $O_2$ content lignite or brown coal is mixed with bituminous coal to provide exothermic conditions and reduce extraneous heat to the liquefaction reactor. In addition, with a crude oil carrying stream for the coal to the reactor there can be conversion at the controlled heating of 380° to 400° C., and in the presence of $H_2$ and CO at 100 to 200 atmospheres a maximizing of distillate from the crude and a high conversion of coal to liquified distillate.

5 Claims, 1 Drawing Figure

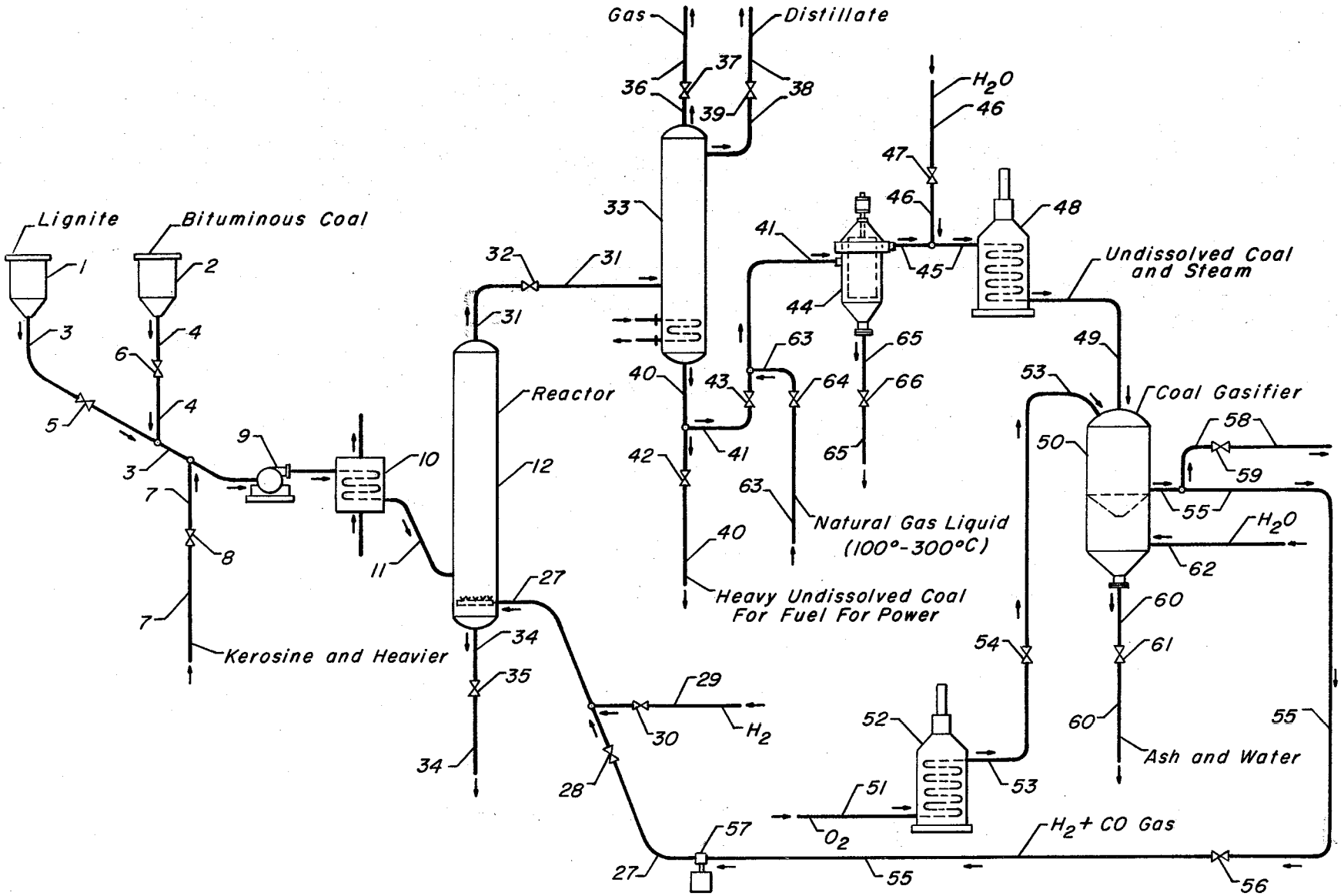
Undissolved Coal and Steam
Coal Gasifier
Ash and Water
$H_2O$
$H_2 + CO$ Gas
Distillate
Gas
Natural Gas Liquid (100°-300°C)
Heavy Undissolved Coal For Fuel For Power
Reactor
Bituminous Coal
Lignite
Kerosine and Heavier
$O_2$
$H_2$

COAL LIQUEFACTION AND OIL UPGRADING PROCESS TO OBTAIN MAXIMUM YIELD OF DISTILLATE

This invention is directed to an improved method of carrying out coal liquefaction with a minimum of heat input and, at the same time, providing a substantially asphaltene free extract.

In a more specific aspect, a lignite type of coal is mixed with bituminous coal such that there is a controlled exothermic reaction temperature to not greater than about 400° C. in the liquefaction reactor.

The present invention also provides for a processing operation where there is an upgrading of the coal carrying petroleum stream (which can be any cut or mix of cuts and oils boiling in the 200° C. to 500° C. range, regardless of being a vacuum or atmospheric distillate), such that there is an upgrading of both the distillate oil and the dissolved portion of the coal to get a maximum yield of distillate. This is accomplished by a partial hydrocracking and also a partial desulfurization of the distillates to be of particular value.

BACKGROUND OF INVENTION

It is recognized that there have been various processes for carrying out the solvent extraction of coal. Typically, coal is pulverized and mixed with a hydrocarbon solvent, with the mixture then being subjected to heat and pressure in the presence of a hydrogen gas stream. The resulting liquid mixture of solvent and dissolved coal is then separated from the undissolved coal, ash and inorganic material by settling, filtration, etc.

Also, typically, coal liquefaction has been carried out at temperatures exceeding 400° C. in order to dissolve a large amount of the coal in the shortest time possible. However, processing along these lines may be looked at as being counter productive in that the basic coal chemistry and resulting chemical composition of the coal liquids is not the most desirable. For present day energy needs, we require a good distillable material that is generally free of asphaltenes and should be soluble in heptane, particularly since liquified coal, whether used as fuel oil or whether to be hydrocracked to distillate, has to be desulfurized. Without going into detail, it is well recognized that desulfurization is very difficult with asphaltenes present. They decompose to coke, gas and light distillate such that desulfurization catalysts are rapidly deactivated to have an uneconomical short life of perhaps only nine or ten months. Even at uneconomic low space velocities, the active sites of the catalyst will be covered over to reduce its useful life in a reactor.

With regard to totally liquified coals, or the so called "solvent refined coal", with a melting point of about 175° C., there results only about 20 to 30% of pentane soluble material and some 50% that is not even benzene soluble. To convert this type of liquified coal to acceptable fuel takes one or more very high pressure hydrogen treating processes at extremely low space velocities such that the economics seems totally unacceptable.

PRESENT INVENTION

In view of the problems of the foregoing generally conventional processes, it is deemed preferable to use an operation as provided by this invention which extracts only the pentane or heptane soluble portion of the coal, meaning a substantially asphaltene free portion and then use the heavy insoluble portion for fuel in power production or for hydrogen production in a water-gas producer.

In order to achieve a maximum amount of heptane soluble material with economically feasible hydrogen pressures in the 1000 to 2000 psi range, it has been found desirable to operate the extraction process in the narrow temperature range of 380° C. to 400° C., without going higher. The 380° C. is required to make the coal plastic and start to break down. In accordance with the present invention, it is also a feature thereof to use lignite or a brown coal with $O_2$ contents over 18%, such that there is derived the benefit of an exothermic reaction at temperatures above about 360° C. Thus, by commingling a proper amount of a lignite coal (this terminology being used herein to include brown coal and other high $O_2$ content coals) with bituminous coal in a solvent stream it is possible to reach just the proper desired temperature of about 390° C. without overheating the charge mixture and obtain of the order of 40% to 60% heptane soluble material with a hydrogen containing gas stream pressure of only of the order of 2000 psi.

In accordance with the foregoing aspects, a principal object of this invention is to achieve an improved, energy saving, operation to carry out the liquefaction of coal.

It is also an object of this invention to have a process which results in a substantially asphaltene free type of heptane soluble coal extract.

In a further aspect, there is an overall process providing that the heavy insoluble coal fraction can be used to supply all, or in part, the hydrogen requirements of the process by integrating a water-gas production section or coal gasifier type unit into the combination operation. Actually, it is deemed preferable to use hydrogen together with carbon monoxide in the liquefaction of brown coal and lignite so that the combining of a water-gas producer may be of particular advantage in an integrated system.

A still further and important object of the present invention provides for simultaneously upgrading a petroleum carrying system with a boiling point of 200°+C. such as a topped crude, by converting a part of the higher boiling portion of the distillate to improved lower boiling distillate while also effecting the coal liquefaction to obtain valuable distillate from the coal.

In a broad aspect the present invention embodies an improved combined oil upgrading and coal liquefaction process that maximizes the yield of valuable distillate, which comprises (a) combining high oxygen content subdivided lignite type coal with subdivided bituminous coal and with an upgradable liquid petroleum stream characterized as being of the kerosine and heavier range boiling from about 200° C. to 500° C.; (b) subjecting this solids-liquid stream mixture to controlled heating to obtain an exothermic decomposition of the lignite and a resulting temperature of the order of 390° C. to 400° C. while in a confined zone with a hydrogen-carbon monoxide containing atmosphere and at an elevated pressure in the range of from 100 to 200 atmospheres; and (c) from the thusly treated mixture recovering a desired distillable fraction, which will include dissolved coal, and also separating a heavy generally non-distillable fraction of undissolved coal and asphaltic material.

In another embodiment, the present invention will provide for an added integrated combination where the heavy non-distillable fraction is subjected to heat and the coal solids-liquid stream mixture is heated to a temperature of the order of 360° C. to 380° C. to initiate said exothermic decomposition temperature for the elevated pressure in the presence of the hydrogen-carbon monoxide containing atmosphere, or preferably, a hydrogen-carbon monoxide atmosphere.

As hereinbefore set forth inpart, to provide a valuable desirable type of "distillate", in accordance with the teachings of this invention, the distillate will be substantially free of asphaltenes and can readily lend itself to the production of low sulfur atmospheric distillate.

With regard to the hydrogen and carbon monoxide gas stream to be used in the process, there is no requirement that it will have to be relatively clean or pure. It may well contain some hydrogen sulfide, carbon monoxide, or $CO_2$. Actually, a preferred economical, integrated operation, will embody an overall system where the undissolved coal residue is sent to a coal-gasifier section to obtain a hydrogen rich stream that, in turn, supplies a $H_2$-CO stream for the liquefaction reactor. In a still further operation there can be an economical use of the CO portion of the gas stream to produce iron powder from the pyrite contained in the undissolved coal.

In connection with the topped crude or other liquid solvent stream, it is not intended to be limiting as to the particular nature. Typically, in accordance with the present invention directed to economic aspects, the carrying liquid will be a kerosine fraction and/or a higher boiling fraction, in the 200° C. to 500° C. range, such as from an atmospheric distiller or from a vacuum distiller, which does comprise an "upgradable" petroleum from the point of view of getting a more valuable distillate that will be low in asphaltenes as well as having been subjected to hydrocracking and a partial desulfurization in the liquefaction reactor.

In carrying out the mixing and reducing operation of the liquefaction process, varying quantities of solids and carrying liquid may be used. For example, but not limiting, approximate equal quantities of lignite and bituminous coal will be used where the lignite has of the order of 18% to 25% oxygen content. Where there is better than a 20% $O_2$ content, then a lesser ratio of lignite might be used. On the other hand, with varying $O_2$ content coals, there can be some compensation in the amount of extraneous heat supplied to the mixture to initiate the exothermic reaction and maintain proper liquefaction operation in the 390° C. range.

Reference to the accompanying drawing and the following description thereof will assist in the further understanding of the operation of the present invention as well as set forth further variations and advantages obtainable by the overall process.

Referring now to the drawing, there are indicated the lignite and bituminous coal supply areas 1 and 2 which provide for feeding the respective desired quantities of subdivided lignite and bituminous coals through line 3, with valve 5, and through the line 4, with control valve 6. Line 3 is shown as joining with line 6 having a control valve that in turn provides a liquid petroleum stream which will serve as the coal solvent and coal carrying stream, such that a heated mixed stream can be charged to the liquefaction zone.

In the present drawing, there is indicated a high pressure pumping means 9 for passing the coal-lignite-solvent mix through a heater means 10 and line 11 into a reactor 12. The heating means need not be limited to any one type of unit, but typically could be a hot flue gas or flame type of heater. The heater might also comprise a suitable high temperature heat exchanger means with a heat supplying medium suitable for effecting a final charge temperature in the 360° C. to 380° C. range. Although not shown, the liquid solvent stream introduced by way of line 7 can be heated to the liquefaction range for the coal mixture.

In the liquefaction reactor 12, the heated coal-solvent mixture is brought into admixture with a hydrogen-carbon monoxide ($H_2$-CO) gas stream entering by way of line 27 and control valve 28. The drawing shows an upflow aerating mixing operation to effect a desired partial liquefaction of the coal mixture, as well as some hydrocracking and desulfurization of the solvent and liquid product stream. Also, as has been indicated for this invention, the charge temperature of the order of 360° C.–380° C. for stream of coals will cause an exothermic reaction from the high $O_2$ content of the lignate portion such that a resulting 390° C. range temperature will be reached in the reactor, while under a relatively high superatmospheric pressure of from about 1,500 to 3,000 psi. A start-up gas stream is provided from line 29, with valve 30, connecting to the $H_2$-CO line 27.

The product stream from the reactor is shown carrying overhead, including undissolved powdered coal, by way of line 31 and valve 32 to enter a distiller unit 33. From the lower end of the reactor 12 there can be the discharge of heavy slag and inorganic materials by way of a line 34 and valve 35.

Diagrammatically, distiller section 33 shows an overhead gaseous discharge line 36 and valve 37 as well as a line 38 and valve 39 for the withdrawal of valuable distillate material. At the same time a valuable undissolved coal slurry is withdrawn from the lower end of the column 33 by way of lines 40 and 41. As indicated, a portion of the undissolved coal can be used for fuel in plant furnaces and heaters while another portion is integrated into the overall process to provide $H_2$ and CO for the reducing reactor 12. Line 41 carries to a separator 44 which separates some of the slurry liquid from coal particles. Thus, coal carrying by way of line 45 can have water added from line 46 and valve 47 to be heated in a suitable heater means 48 and then carried through line 49 with steam to a coal gasifier means at 50. Also, for the coal gasifier, oxygen is introduced through a line 51 to a heater 52 and then by way of line 53 and valve 54 to unit 50 for admixture with the coal and steam. A resulting $H_2$ and CO rich gas stream is shown diagrammatically as leaving the unit by way of line 55 and valve 56 to then pass to compressor 57 for high pressure discharge into the reactor by way of line 27 and valve 28. Any excess $H_2$ and CO can be withdrawn from line 55 by use of line 58 and valve 59. Also, ash and water can be withdrawn from a quench zone of the generator 50 by way of line 60 and valve 61. Water for quenching slag is indicated as entering the generator at line 62.

It is to be noted that there may be embodied various systems of coal gasification in the utilization of undissolved coal for making a reducing gas that is, in turn, used in the coal liquefaction step. For example, there are "fixed" and "fluidized" bed processes; atmospheric and elevated pressure processes, etc. By name, there are reports covering the Lurgi pressure gasifier; the Koppers-Totzek gasifier; the Ruhrgas Vortex gasifier; the Texaco gasifier; etc., and it is not intended to limit this overall process to the use of any one type of unit or system.

As a further adjunct to the present combination process, it is to be noted that the CO content of the gas from the gasifier unit can be used to advantage to make iron powder from iron pyrite in turn recovered from the coal liquefaction unit.

The accompanying drawing is, of course, diagrammatic in order to briefly illustrate the present processing operation and some variation with respect thereto. However, variations can be made within the scope of present invention as to flow and as to types of equipment, etc. For example, there may be variations as to the types and flows in the reactor zones, as well as with the separating and product recovery zones. Also, the distillation-fractionation zone indicated may well be a more sophisticated type of distiller and fractionator construction suitable to obtain a variety of desired fractions. In a preferred operation, it may be desirable to effect a multi-stage separation of coal extract from the insoluble coal particles by diluting with approximately one volume of a naphtha cut, of about 100° C. to 150° C. boiling range and centrifuging at about 100° C. to 200° C. under pressure not exceeding about 150 psi., however, other suitable cuts could be utilized. In the present simplified drawing, a natural gas liquid, boiling in the 100° C. to 300° C. range is shown being introduced into the slurry line 41 by way of line 63 and valve 64 so as to assist in obtaining further extract from the coal particles. The diluting cut and extract can be withdrawn from the separator 44 by way of line 65 and valve 66. As an alternative there may also be a separation step of a similar nature ahead of the distillation zone 33.

As hereinbefore set forth, the charge quantities can vary depending upon the actual monitoring of the oxygen content of the brown coal, or lignite type coal. When more exothermicity is desired, then more lignite can be added to the ratio. Typically, about one part of lignite will be used for one part of bituminous coal along with about two parts of the gas-oil, or other solvent. Also, typically, about 1.4 barrels of good distillate will be produced from the coals and the solvent, based upon the solvent utilized from one barrel of crude oil.

It is to be still further noted, by way of summary, that there will be produced an asphaltene free coal extract in a manner that can be at lower than conventional hydrogen pressures and with less than conventional BTU consumption by reason of making use of the exothermicity of the lignite type coals. In addition, one can readily obtain desired heptane soluble fractions from the low grade coals as a distillate free of asphaltenes, a separation process which is simpler and much more economical than solvent separation, settling on centrifugation.

I claim as my invention:

1. An improved combined oil upgrading and coal liquefaction process that maximizes the yield of valuable distillate, which comprises:

(a) combining high oxygen content subdivided lignite type coal with subdivided bituminous coal and with an upgradable liquid petroleum stream characterized as being of the kerosine and heavier range boiling from about 200° C. to 500° C.

(b) subjecting this solids-liquid stream mixture to controlled heating without going higher than 400° C. to obtain an exothermic decomposition of the lignite and a resulting temperature of the order of 390° C. to 400° C. while in a confined zone with a hydrogen containing atmosphere and at an elevated pressure in the range of from 100 to 200 atmospheres, and (c) from the thusly treated mixture recovering a desired distillable fraction, which will include dissolved coal, and also separating a heavy generally non-distillable fraction of undissolved coal and asphaltic material.

2. The process of claim 1 further characterized in that the coal solids-liquid stream mixture is heated to a temperature of the order of 360° C. to 380° C. to initiate solid exothermic decomposition temperature for the elevated pressure in the presence of the hydrogen containing atmosphere.

3. The process of claim 2 still further characterized in that said heated solids-liquid stream is introduced to the lower portion of a confined pressure tight zone and a hydrogen containing reducing gas stream is also introduced to the lower portion of said zone to provide said hydrogen atmosphere and both said streams pass in an upward, mixing flow, through said zone to effect at least a partial liquefaction of said coals.

4. The process of claim 1 further characterized in that the heavy non-distillable fraction is subjected to heat, oxygen and steam in a coal gasification reaction to provide a resulting hydrogen and carbon monoxide containing gas stream which is used at least in part to mix with said combined stream of subdivided coals and liquid petroleum as said hydrogen containing atmosphere.

5. The process of claim 1 further characterized in that the sub-divided coals are subjected to a pretreatment with liquid sulfur dioxide while at an elevated temperature and elevated pressure to provide for the powdering of the coals and then using the recovered resulting powdered coals for introduction to said confined zone for liquefaction.

* * * * *